US011274268B2

(12) United States Patent
Goo et al.

(10) Patent No.: US 11,274,268 B2
(45) Date of Patent: Mar. 15, 2022

(54) DETERGENT COMPOSITIONS FOR REMOVING HEAVY METALS AND FORMALDEHYDE

(71) Applicants: FNG RESEARCH CO., LTD., Cheongju-si (KR); Young Sam Goo, Chungcheongnam-do (KR); Ki Nam Son, Cheongju-si (KR)

(72) Inventors: Young Sam Goo, Hongseong-gun (KR); Ki Nam Son, Cheongju-si (KR)

(73) Assignees: FNG RESEARCH CO., LTD., Cheongju-si (KR); Young Sam Goo, Chungcheongnam-Do (KR); Ki Nam Son, Cheongju-si (KR)

( * ) Notice: Subject to any disclaimer, the term of this patent is extended or adjusted under 35 U.S.C. 154(b) by 0 days.

(21) Appl. No.: 16/465,449

(22) PCT Filed: Jun. 2, 2017

(86) PCT No.: PCT/KR2017/005822

§ 371 (c)(1),
(2) Date: May 30, 2019

(87) PCT Pub. No.: WO2018/174337

PCT Pub. Date: Sep. 27, 2018

(65) Prior Publication Data

US 2020/0002649 A1 Jan. 2, 2020

(30) Foreign Application Priority Data

Mar. 23, 2017 (KR) ..... 10-2017-0037032

(51) Int. Cl.

| | |
|---|---|
| ***C11D 3/30*** | (2006.01) |
| ***C11D 3/32*** | (2006.01) |
| ***C11D 3/28*** | (2006.01) |
| ***C11D 11/00*** | (2006.01) |

(52) U.S. Cl.

CPC ..... *C11D 3/32* (2013.01); *C11D 3/28* (2013.01); *C11D 3/30* (2013.01); *C11D 11/0017* (2013.01); *C11D 11/0035* (2013.01)

(58) Field of Classification Search

CPC ..... C11D 3/3932; C11D 3/168; C11D 7/32
USPC ..... 510/302, 309, 311, 376
See application file for complete search history.

(56) References Cited

U.S. PATENT DOCUMENTS

| | | | | |
|---|---|---|---|---|
| 4,786,440 | A * | 11/1988 | Cooper | C11D 3/33 510/345 |
| 7,205,267 | B2 * | 4/2007 | Reinhardt | C11D 3/168 510/311 |
| 2005/0002876 | A1 * | 1/2005 | Yukl | A61P 1/02 424/54 |
| 2005/0113272 | A1 | 5/2005 | Yeung et al. | |
| 2005/0209120 | A1 | 9/2005 | Reinhardt et al. | |
| 2010/0210451 | A1 * | 8/2010 | Busch | B01J 31/182 502/155 |
| 2011/0143925 | A1 * | 6/2011 | Busch | C11D 3/3932 502/161 |
| 2011/0313130 | A1 | 12/2011 | Adam et al. | |
| 2014/0005091 | A1 | 1/2014 | Reinhardt et al. | |
| 2015/0342848 | A1 | 12/2015 | Bhushan et al. | |
| 2019/0388323 | A1 * | 12/2019 | Goo | C07C 229/60 |

FOREIGN PATENT DOCUMENTS

| | | | |
|---|---|---|---|
| JP | 2003-500496 | A | 1/2003 |
| JP | 2005-232450 | A | 9/2005 |
| JP | 5385521 | B2 | 1/2014 |
| JP | 2014-511404 | A | 5/2014 |
| JP | 5735954 | B2 | 8/2015 |
| JP | 5856982 | B2 | 2/2016 |
| JP | 2016-509584 | A | 3/2016 |

* cited by examiner

*Primary Examiner* — Gregory E Webb
(74) *Attorney, Agent, or Firm* — Birch, Stewart, Kolasch & Birch, LLP

(57) ABSTRACT

The present invention provides a detergent composition for removing heavy metals and formaldehyde, comprising at least one selected from the group consisting of trientine or trientine derivative of Formula (1), cyclen or cyclen derivative of Formula (2), cyclam or cyclam derivative of Formula (3), and a salt thereof.

4 Claims, No Drawings

DETERGENT COMPOSITIONS FOR REMOVING HEAVY METALS AND FORMALDEHYDE

CROSS REFERENCE TO RELATED APPLICATIONS

This application is the National Phase of PCT/KR2017/005822 filed on Jun. 02, 2017, which claims priority under 35 U.S.C. § 119(a) to Patent Application Nos. 10-2017-0037032 filed in the Republic of Korea on Mar. 23, 2017, all of which are hereby expressly incorporated by reference into the present application.

TECHNICAL FIELD

The present invention relates to a detergent composition which can be used as a laundry detergent, a household detergent for plastics, toys, feeding bottles, a furniture cleaning detergent, dishwashing detergent and so on. In particular, the present invention relates to a detergent composition for effectively removing heavy metals and formaldehyde which are present in these materials.

BACKGROUND ART

Air pollution is getting worse with industrial development. Major air pollutants are volatile organic compounds (VOCs) such as formaldehyde, harmful gases such as sulfur dioxide, nitrogen oxides, ozone and carbon monoxide, and heavy metals such as Pb, Cd, As, Cr, Cu, Ni. These pollutants are commonly absorbed or condensed into fine dusts ($PM_{10}$) or ultrafine dusts ($PM_{2.5}$), and enter into the body through the respiratory tract, thereby causing various respiratory diseases such as asthma and lung function deterioration. Also these pollutants cause various skin diseases such as dermatitis, allergy, atopy and the like.

Formaldehyde is a representative VOC which is classified as carcinogenic to humans, and is well known as the atopy-inducing substance.

Although the components of fine dusts depend on area, environment and season, it has been reported that harmful heavy metals such as Hg, Pb, Cd, As, Cr, Cu, Ni, Zn, Mn, Co and Sn are contained in the fine dust in an amount of about 20 wt %.

These fine dusts flow into the house through windows as well as in the outdoor environment and are harmful to human body. In addition, the fine dusts may adhere to the clothes and penetrate into the fibers during external activities so that enter into the house.

The laundry detergent includes a surfactant, an alkaline builder, a water softener and additives. Mainly an anionic surfactant and a nonionic surfactant are used as cleaning components in order to exert excellent detergency against the contaminants of the laundry. The alkaline builder is used for enhancing detergency. The water softener forms a chelate with calcium or magnesium ions in the hard water, thereby preventing $Ca^{2+}$ and $Mg^{2+}$ from binding with the surfactant. A bleaching agent, enzyme, fabric softener may be included as other additives.

The laundry detergents are generally excellent for removing dirt and stains on clothes, however, it is recently reported that after washing with washing machine, a large amount fine dusts and heavy metals still remain in clothes. This is because the particle size of the fine dust is so small that it is deeply penetrated into the fibers and is not sufficiently removed during the washing process. There is almost no laundry detergent specialized in the removal of heavy metals.

Meanwhile, fine dust accumulates on agricultural products during the cultivation and distribution of agricultural products such as fruits and vegetables, and there is almost no dishwashing detergent or fruit detergent to effectively remove such heavy metals.

On the other hand, heavy metals and formaldehyde may be contained in the various household products such plastics products, processed wood (particle board, MDF etc), interior products, wallpaper, flooring materials and so on. These may exist in raw materials itself or be introduced during manufacturing processes thereof.

Particularly, formaldehyde is a representative volatile organic compound (VOC) classified as a carcinogen to humans, which is a major cause of sick house syndrome. Formaldehyde is a component used in the manufacture of various interior materials such as furniture, wallpaper, processed wood and flooring. Although detergents containing phytoncide are commercially available to remove formaldehyde from these products, it has been reported that the phytoncide is not effective in removing formaldehyde.

DISCLOSURE OF INVENTION

Technical Problem

It is an object of the present invention to provide a detergent composition such as laundry detergents, dishwashing detergent, and household detergents (cleaning agents), capable of effectively removing heavy metals and formaldehyde.

Solution to Problem

The present invention provides a detergent composition for removing heavy metals and formaldehyde, comprising at least one selected from the group consisting of trientine or trientine derivative of Formula (1), cyclen or cyclen derivative of Formula (2), cyclam or cyclam derivative of Formula (3), and a salt thereof.

(1)

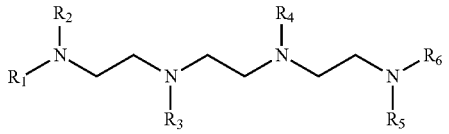

(2)

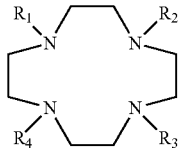

(3)

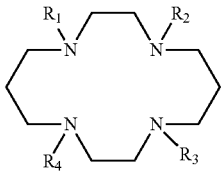

wherein: $R_1$, $R_2$, $R_3$, $R_4$, $R_5$ and $R_6$ is each independently hydrogen, —$R_7$—COOH;

$R_7$ is a $C_1$-$C_5$ alkyl group, an unsubstituted or substituted aromatic hydrocarbon group, or an unsubstituted or substituted aromatic heterocyclic group.

In the present invention, the effective ingredient for removing heavy metals and formaldehyde is preferably selected from trientine of Formula (1a), cyclen of Formula (2a), and cyclam of Formula (3a).

(1a)

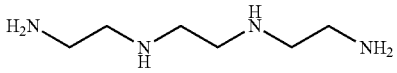

(2a)

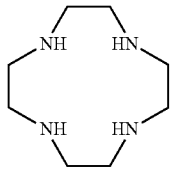

(3a)

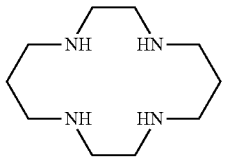

The trientine derivative is preferably selected from compounds of Formula (1b) to (1d) or a salt thereof.

(1b)

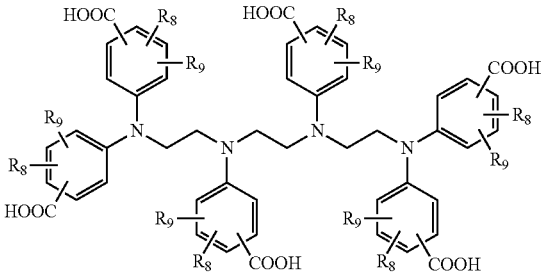

(1c)

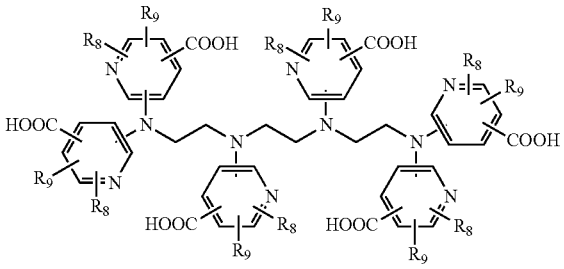

(1d)

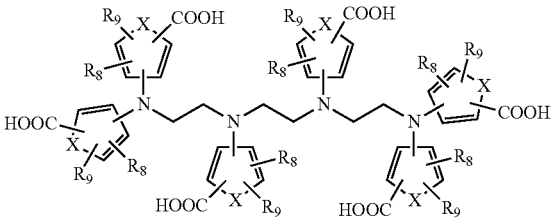

wherein: $R_8$, $R_9$ is each independently hydrogen or $C_1$-$C_4$ alkyl;

X is oxygen, sulfur or nitrogen atom.

The cyclen derivative is preferably selected from compounds of Formula (2b) to (2d) or a salt thereof.

(2b)

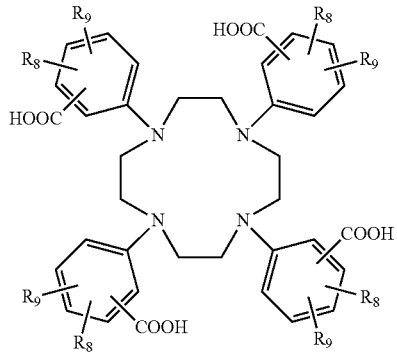

(2c)

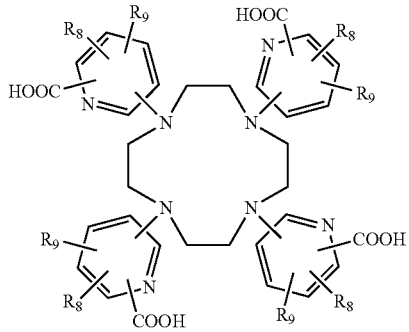

(2d)

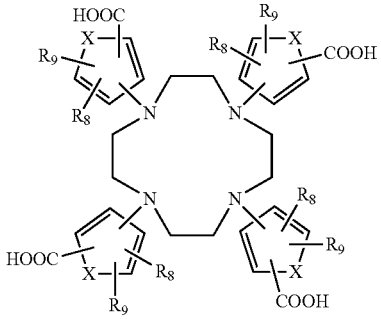

wherein: $R_8$, $R_9$ is each independently hydrogen or $C_1$-$C_4$ alkyl;

X is oxygen, sulfur or nitrogen atom.

The cyclam derivative is preferably selected from compounds of Formula (3b) to (3d) or a salt thereof.

(3b)

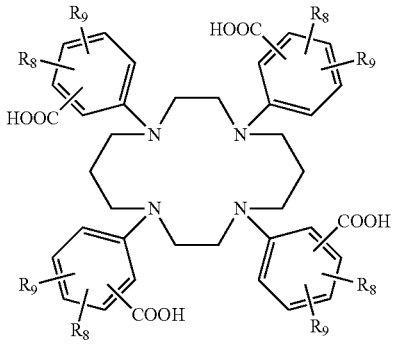

(3c)

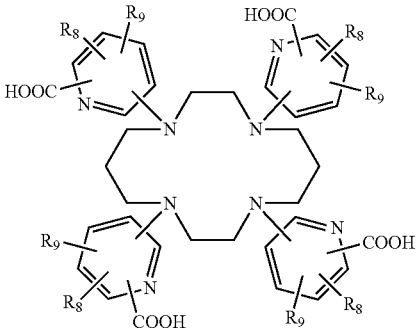

(3d)

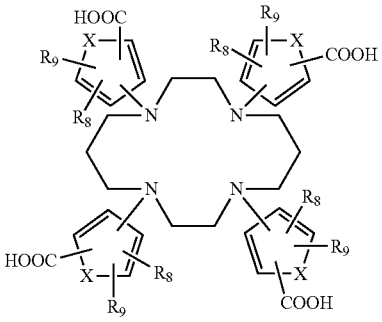

wherein: $R_8$, $R_9$ is each independently hydrogen or $C_1$-$C_4$ alkyl;

X is oxygen, sulfur or nitrogen atom.

Advantageous Effects of Invention

The detergent composition of the present invention has an effect of removing formaldehyde and has strong heavy metal removal ability even in a small amount in comparison with the conventional chelating agent. On the other hand, the composition for skin of the present invention has no or little skin irritation and toxicity, and thus can be effectively used as a detergent.

BEST MODE FOR CARRYING OUT THE INVENTION

In the present invention, term "detergent" comprises the meaning of cleansing detergent, washing detergent.

The inventors of the present invention have conducted various studies on heavy metal chelating agents in order to develop a detergent composition capable of effectively removing heavy metals present in various products such as clothes dust, plastics, and furniture. It has been disclosed in the present invention that trientine, cyclen, cyclam and derivatives thereof are very excellent in removing heavy metals as well as formaldehyde when used as a component of laundry detergent, plastics detergent and household detergent etc.

Trientine of the following Formula (1a) is a generic name of Triethylenetetramine (TETA).

(1a)

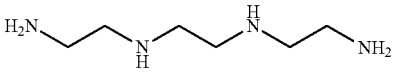

Triethylenetetramine dihydrochloride has been shown to participate in the metabolism of copper in mouse experiments (F. W. Sunderman et al., *Toxicol. Appl. Pharmacol.* 38, 177 (1976)). Triethylenetetramine dihydrochloride is pharmacologically well known as a chelating agent for copper, so is well known as a treatment for Wilson's disease (J M Walshe, *Prog. Clin. Biol. Res.* 34, 271 (1979); R H Haslam et al., *Dev. Pharmacol Ther.* 1, 318 (1980)).

Cyclen of the following Formula (2a) is a generic name of 1,4,7,10-tetraazacyclododecane. It forms a chelate through coordination bond with gadolinium (Gd) and is used for nuclear medical contrast agent.

(2a)

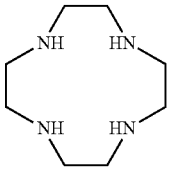

Cyclam of the following Formula (3a) is a generic name of 1,4,8,11-tetraazacyclotetradecane. It also forms a chelate through coordination bond with gadolinium (Gd) and is used for nuclear medical contrast agent.

(3a)

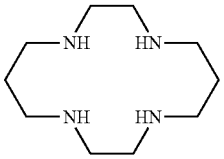

Chelating agents such as trientine, cyclen and cyclam, are pharmaceutically well known for their ability to release copper in the body via oral or vascular administration methods, or use thereof as a contrast agent. However, these have not been reported for use as a detergent ingredient capable of effectively removing heavy metals and formaldehyde.

The present invention discloses trientine, cyclen, cyclam and derivatives thereof is very useful as a detergent ingredient capable of effectively removing heavy metals and formaldehyde. Also the present invention discloses these compounds have no skin irritation and toxicity.

Trientine, cyclen and cyclam are known to be harmful to the skin in the past. As a result of the experiments of the present invention, it has been found that the use of an effective amount for removing heavy metals does not cause skin irritation and toxicity, so that it can be acceptable as detergent ingredients.

On the other hand, it is disclosed by the present invention that trientine, cyclen, cyclam and derivatives thereof are very effective for the removal of formaldehyde which is a primary carcinogen.

The present invention provides a detergent composition for removing heavy metals and formaldehyde, comprising at least one selected from the group consisting of trientine or trientine derivative of Formula (1), cyclen or cyclen derivative of Formula (2), cyclam or cyclam derivative of Formula (3), and a salt thereof.

(1)

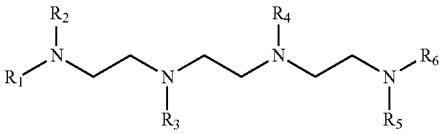

(2)

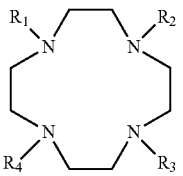

(3)

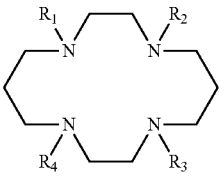

wherein: $R_1$, $R_2$, $R_3$, $R_4$, $R_5$ and $R_6$ is each independently hydrogen, —$R_7$—COOH;

$R_7$ is a $C_1$-$C_5$ alkyl group, an unsubstituted or substituted aromatic hydrocarbon group, or an unsubstituted or substituted aromatic heterocyclic group.

The detergent composition of the present invention is characterized in that it comprises trientine, trientine derivatives, cyclen, cyclen derivatives, cyclam, cyclam derivatives or a salt thereof as an effective ingredient for removing heavy metals and formaldehyde.

On the other hand, in the present invention, it is confirmed that the introduction of a carboxyl group at the amine position of trientine, cyclen and cyclam improves the degree of coordination of heavy metal, while the introduction of an aromatic or heterocyclic group at the amine position significantly reduces skin irritation.

The trientine derivatives, cyclen derivatives and cyclam derivatives according to the present invention are preferably selected from the compounds of the following Formulas (1b) to (3d).

(1b)

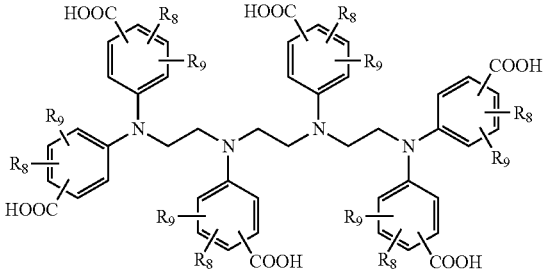

(1c)

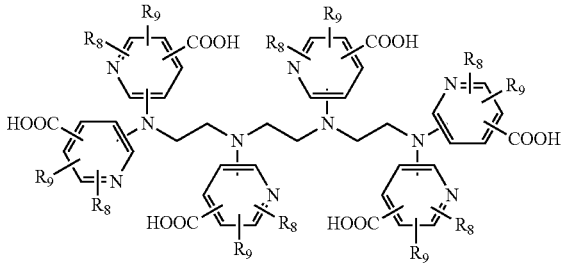

(1d)

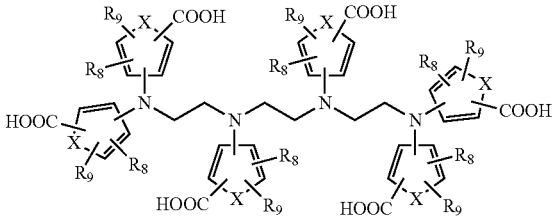

(2b)

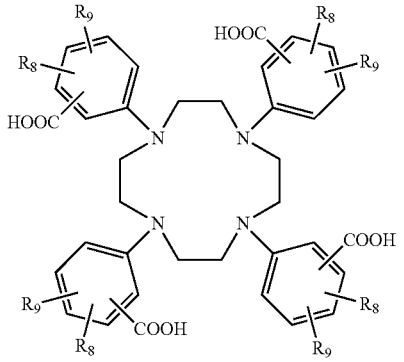

(2c)

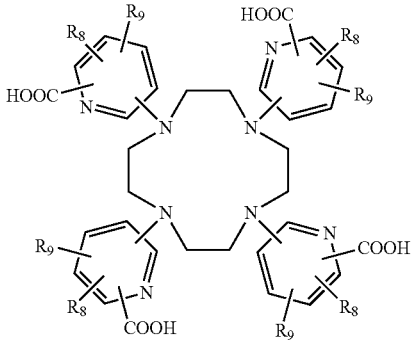

-continued (2d)

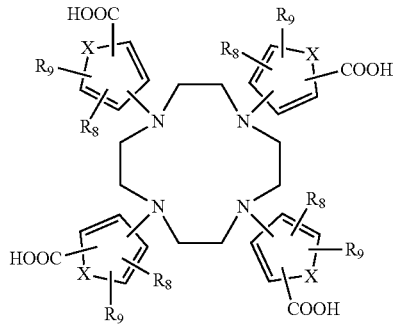

(3b)

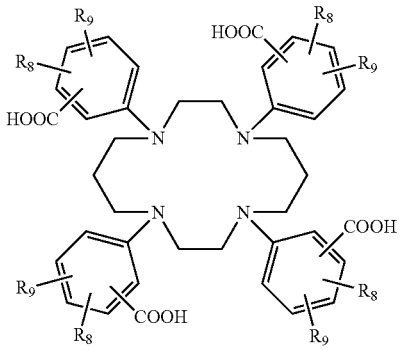

(3c)

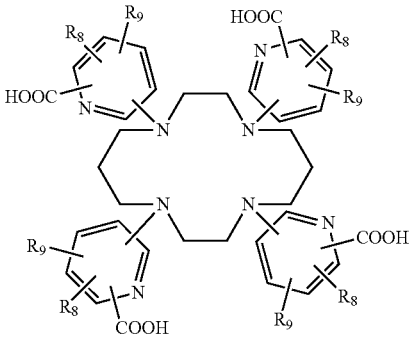

(3d)

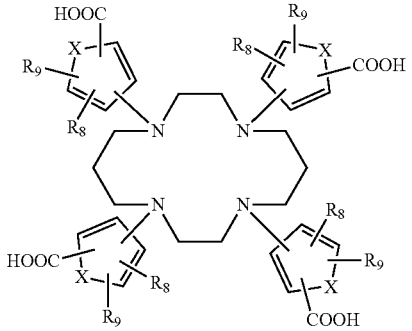

wherein: $R_8$, $R_9$ is each independently hydrogen or $C_1$-$C_4$ alkyl;

X is oxygen, sulfur or nitrogen atom.

The trientine or trientine derivatives, cyclen or cyclen derivatives, cyclam or cyclam derivatives of the present invention is not limited, but is 0.01 to 5.0 wt %, preferably 0.1 to 5.0 wt %, more preferably 0.5 to 3.0 wt %, based a total weight of the composition.

The trientine or trientine derivatives, cyclen or cyclen derivatives, cyclam or cyclam derivatives of the present invention may be used in the form of water-soluble salts. The said compounds of the present invention may be used in the form of the hydrochloride salt, the sodium salt, and the potassium salt. The said salts of the present invention can be obtained by a known method for preparing the salts. The salt of the present invention is preferably dihydrochloride or tetrahydrochloride, more preferably dihydrochloride.

The composition of the present invention can be used for removing heavy metal ions such as Hg, Pb, Cd, As, Cr, Cu, Ni, Zn, Mn, Co and Sn which be attached on the surface of household products.

The laundry detergent composition of the present invention includes a surfactant as a cleaning component (contaminant, stain, and removal) of laundry. And the laundry detergent may include an alkali builder and a water softening agent for improving the detergency of the surfactant. Other additives such as bleaching agents, enzymes, fabric softeners, fluorescent dyes, perfumes may be included.

The surfactant may be a synthetic surfactant or a natural surfactant. The surfactant may be an anionic surfactant, a nonionic surfactant, a cationic surfactant or a mixed surfactant thereof, preferably a mixed surfactant of an anionic surfactant and a nonionic surfactant. The anionic surfactants is not limited to, but $C_{10}$-$C_{18}$ linear alkylbenzene sulfonates (LAS), $C_{10}$-$C_{18}$ branched alkyl benzene sulfonates (ABS), alpha olefins sulfonate. The nonionic surfactant is not limited to, but fatty acid alkyl polyoxyethylene glycols, fatty acid polyoxyethylene glycols, alkylphenyl polyoxyethylene glycols, polyoxyethylene glycols and the like. The surfactant may be comprised in an amount of 10 to 40 wt %, preferably 15 to 30 wt % based on the total weight of detergent composition.

The water softener forms a chelate with calcium or magnesium ions in the hard water, thereby preventing calcium and magnesium ions from binding the anionic surfactant. The water softener may be zeolite, phosphate (tripolyphosphate, pyrophosphate), sodium sesquicarbonate, layered silicate, or the like. The water softener is not limited, but may be included in an amount of 5 to 40 wt % based on the total weight of detergent composition.

The alkali builder is not limited, but is preferably a carbonate such as sodium carbonate or sodium hydrogencarbonate, a layered crystalline $\alpha$-$Na_2SiO_3$ or a silicate such as ($\beta$-$Na_2SiO_3$. The alkali builder is not limited, but may be included in an amount of 10 to 50 wt % based on the total weight of the detergent composition.

The bleaching agent is not limited, but peroxides such as percarbonate and perborate, and the peroxide may be preferably included in an amount of 1 to 20 wt % based on the total weight of the detergent composition.

The enzyme may be a protease, a carbohydrase, a cellulase, and is preferably comprised in an amount of 0.1 to 0.5 wt %.

The detergent compositions of the present invention can be used as household detergents such as detergents for plastics, dishwashing detergent, feeding bottle detergents, bathroom detergents and so on. The detergent composition of the present invention may be prepared by adding trientine or trientine derivative, cyclen or cyclen derivative, cyclam or cyclam derivative to a known detergent composition in an amount of 0.01 to 5.0 wt %, preferably 0.1 to 5.0 wt %, more preferably 0.5 to 3.0 wt %.

The detergent compositions of the present invention may comprise known components of dishwashing detergent, feeding bottle detergents, bathroom detergents and plastics detergents. The content of each component of the detergent composition can be changed within a usual range.

Hereinafter, the detergent composition for removing heavy metals and formaldehyde according to the present invention will be described in detail with reference to the following examples. However, the following examples are only illustrative of the present invention and are not to be construed as limiting the scope of the present invention.

MODE FOR THE INVENTION

Synthesis of Trientine Derivative

Embodiment 1

Preparation of 3,6,9,12-tetrakis(carboxymethyl)-3,6,9,12-tetraazatetradecanedioic Acid (Formula (1e))

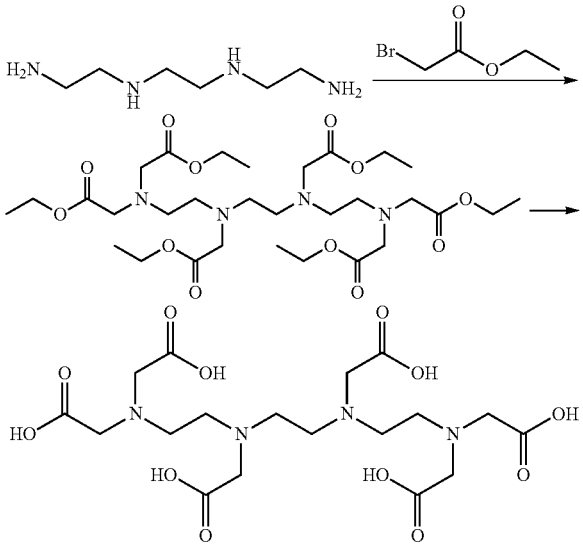

(1e)

Triethylenetetramine (10.0 g) was dissolved in acetonitrile (ACN) (400 ml). $K_2CO_3$ (66.1 g) and ethyl bromoacetate (78.8 g) were added and reaction mixture was heated under stirring and under reflux for about 48 hours. After completion of the reaction, the reaction mixture was cooled to room temperature, and then filtered. A solid phase of the reaction mixture was discarded and the filtrate was concentrated under vacuum. Methylene chloride (MC) (200 ml) and purified water (300 ml) are added to the concentrate and stirred for 30 min, and then an organic layer is separated. The organic layer was treated with $MgSO_4$, concentrated under vacuum, and then subjected to column purification with MC-methanol. 29.6 g of diethyl 3,6,9,12-tetrakis (2-ethoxy-2-oxoethyl)-3,6,9,12-tetraazatetradecanedioate was obtained (Yield: 64.8%).

$^1$H NMR ($CDCl_3$): 4.16 (q, 8H), 4.14 (q, 4H), 3.57 (s, 8H), 3.44 (s, 4H), 2.85 (t, 4H), 2.78 (t, 4H), 2.74 (s, 4H), 1.27 (t, 12H), 1.26 (t, 6H).

Diethyl 3,6,9,12-tetrakis (2-ethoxy-2-oxoethyl)-3,6,9,12-tetraazatetradecanedioate (29.6 g), NaOH (12.33 g), methanol (180 ml) and purified water (120 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (400 ml). The extracted organic layer was treated with $MgSO_4$. 15.9 g of the title compound was obtained (Yield: 72.3%).

$^1$H NMR (DMSO): 4.57 (s, 8H), 4.55 (s, 4H), 4.22 (s, 12H).

Embodiment 2

Preparation of 4,4',4",4'"-(((ethane-1,2-diylbis((4-carboxyphenyl)azanediyl))bis(ethane-2,1-diyl))bis(azanetriyl))tetrabenzoic Acid (Formula (1f))

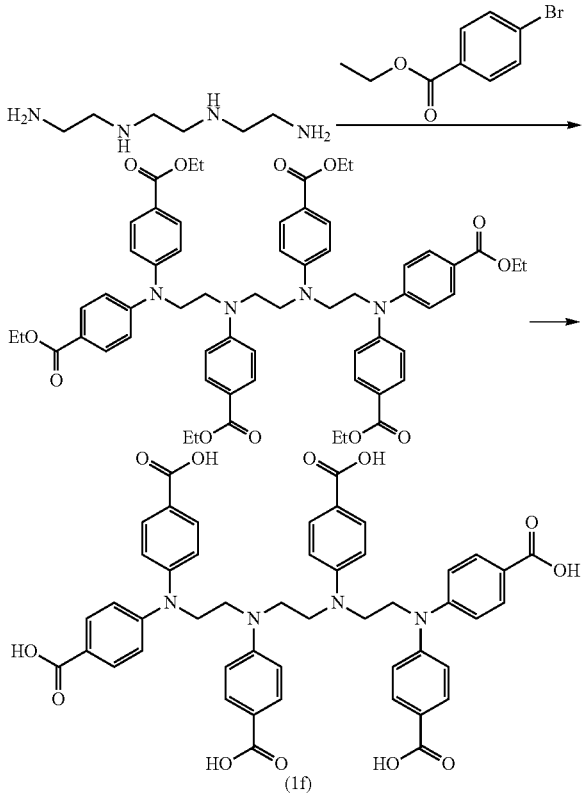

(1f)

Triethylenetetramine (10.0 g), ethyl 4-bromobenzoate (108.1 g), t-BuONa (46.0 g) and toluene (600 ml) were added, stirred, and then heated to 35° C. 50% $(t\text{-}Bu)_3P$ toluene solution (2.8 g) was added, stirred for about 30 min and then heated to 50° C. $Pd(dba)_2$ (Bis(dibenzylideneacetone)palladium) (2.0 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 22.9 g of tetraethyl 4,4',4",4'"-(((ethane-1,2-diylbis((4-(ethoxycarbonyl)phenyl) azanediyl)) bis(ethane-2,1-diyl))bis(azanetriyl))tetrabenzoate was obtained (Yield: 32.4%).

$^1$H NMR ($CDCl_3$): 7.82 (m, 4H), 7.71 (m, 8H), 7.25 (m, 8H), 6.95 (m, 4H), 4.15 (q, 8H), 4.11 (q, 4H), 3.45~3.18 (m, 12H), 1.27 (t, 12H), 1.26 (t, 6H).

Tetraethyl 4,4',4",4'"-(((ethane-1,2-diylbis((4-(ethoxycarbonyl)phenyl)azanediyl)) bis(ethane-2,1-diyl))bis(azanetriyl))tetrabenzoate (22.9 g), NaOH (6.1 g), methanol (180 ml) and purified water (140 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (200 ml). The extracted organic layer was treated with $MgSO_4$. 17.0 g of the title compound was obtained (Yield: 89.0%).

$^1$H NMR (DMSO): 7.80 (m, 4H), 7.68 (m, 8H), 7.15 (m, 8H), 6.94 (m, 4H), 3.41~3.28 (m, 12H).

Embodiment 3

Preparation of 5,5'-((2-((5-carboxypyridin-3-yl)(2-((5-carboxypyridin-3-yl)(2-((5-carboxypyridin-3-yl)(2-carboxypyridin-4-yl)amino)ethyl)amino)ethyl)amino)ethyl)azanediyl)dinicotinic Acid (Formula (1g))

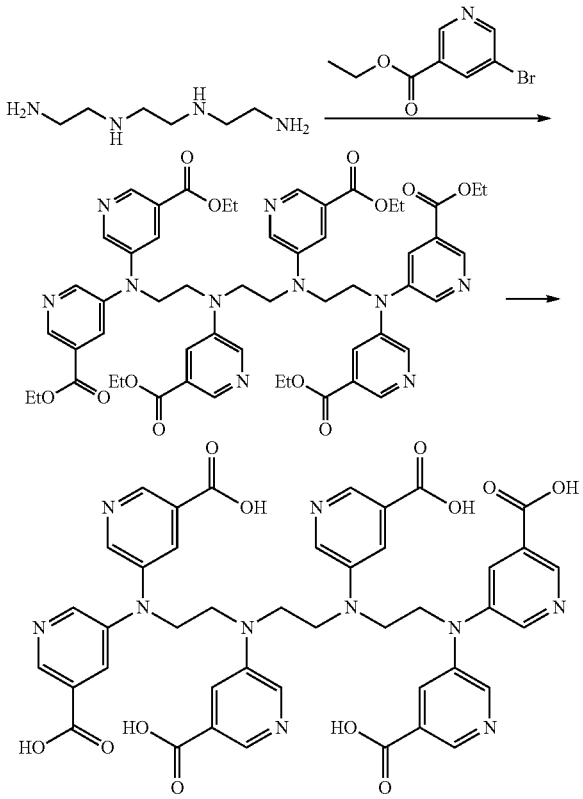

(1g)

Triethylenetetramine (10.0 g), ethyl 5-bromonicotinate (108.5 g), t-BuONa (46.0 g) and xylene (600 ml) were added, stirred, and then heated to 35° C. 50% $(t\text{-Bu})_3P$ toluene solution (2.8 g) was added, stirred for about 30 min and then heated to 50° C. $Pd(dba)_2$ (2.0 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated diethyl 5,5'-((2-((5-(ethoxycarbonyl)pyridin-3-yl)(2-((5-(ethoxycarbonyl)pyridin-3-yl)(2-((5-(ethoxycarbonyl)pyridin-3-yl)(2-(ethoxycarbonyl)pyridin-4-yl)amino)ethyl)amino)ethyl) amino)ethyl)azanediyl)dinicotinate was obtained (Yield: 27.8%).

$^1$H NMR ($CDCl_3$): 8.92 (d, 4H), 8.85 (d, 2H), 8.45 (d, 4H), 8.43 (d, 2H), 7.89 (d, 4H), 7.76 (d, 2H), 4.23 (q, 8H), 4.15 (q, 4H), 3.42~3.11 (m, 12H), 1.27 (t, 12H), 1.26 (t, 6H).

Diethyl 5,5'-((2-((5-(ethoxycarbonyl)pyridin-3-yl)(2-((5-(ethoxycarbonyl)pyridin 3-yl)(2-((5-(ethoxycarbonyl)pyridin-3-yl)(2-(ethoxycarbonyl)pyridin-4-yl)amino)ethyl) amino)ethyl)amino)ethyl)azanediyl)dinicotinate (19.8 g), NaOH (5.3 g), methanol (160 ml) and purified water (120 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (160 ml). The extracted organic layer was treated with $MgSO_4$. 13.0 g of the title compound was obtained (Yield: 78.4%).

$^1$H NMR (DMSO): 8.95 (d, 4H), 8.87 (d, 2H), 8.46 (d, 4H), 8.44 (d, 2H), 7.89 (d, 4H), 7.75 (d, 2H), 3.41~3.11 (m, 12H).

Embodiment 4

Preparation of 5,5',5",5'"-(((ethane-1,2-diylbis((5-carboxyfuran-2-yl)azanediyl))bis(ethane-2,1-diyl)) bis(azanetriyl))tetrakis(furan-2-carboxylic Acid) (Formula (1h))

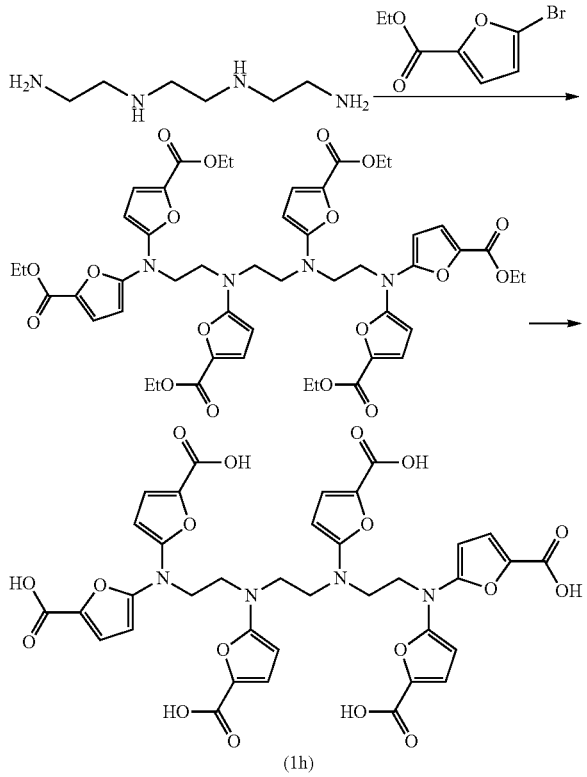

(1h)

Triethylenetetramine (10.0 g), ethyl 5-bromofuran-2-carboxylate (103.3 g), t-BuONa (46.0 g) and toluene (600 ml) were added, stirred, and then heated to 35° C. 50% $(t\text{-Bu})_3P$ toluene solution (2.8 g) was added, stirred for about 30 min and then heated to 50° C. $Pd(dba)_2$ (2.0 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 25.3 g of tetraethyl 5,5',5'',5'''-(((ethane-1,2-diylbis((5-(ethoxycarbonyl)furan-2-yl)azanediyl))bis(ethane-2,1-diyl))bis(azanetriyl))tetrakis(furan-2-carboxylate) was obtained (Yield: 37.9%).

$^1$H NMR ($CDCl_3$): 7.42 (m, 12H), 4.31 (q, 8H), 4.28 (q, 4H), 3.65~3.15 (m, 12H), 1.27 (t, 12H), 1.25 (t, 6H).

Tetraethyl 5,5',5'',5'''-(((ethane-1,2-diylbis((5-(ethoxycarbonyl)furan-2-yl)azanediyl))bis (ethane-2,1-diyl))bis(azanetriyl))tetrakis(furan-2-carboxylate) (25.3 g), NaOH (7.2 g), methanol (200 ml) and purified water (150 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (200 ml). The extracted organic layer was treated with $MgSO_4$. 15.0 g of the title compound was obtained (Yield: 71.8%).

$^1$H NMR (DMSO): 7.41 (m, 12H), 3.67~3.15 (m, 12H).

Synthesis of Cyclen Derivative

Embodiment 5

Preparation of 2,2',2'',2'''-(1,4,7,10-tetraazacyclododecane-1,4,7,10-tetrayl)tetraacetic Acid (Formula (2e))

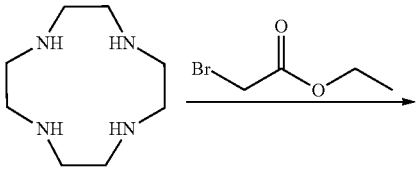

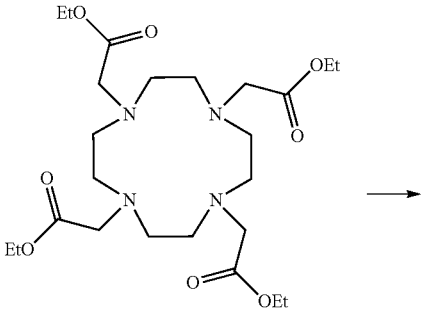

-continued

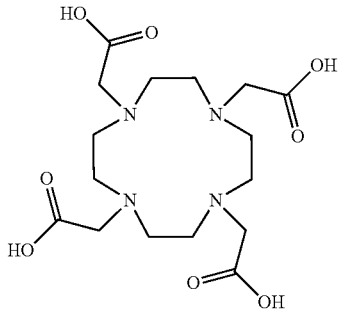

(2e)

Cyclen (10.0 g) was dissolved in acetonitrile (400 ml). $K_2CO_3$ (40.1 g) and ethyl bromoacetate (42.7 g) were added and reaction mixture was heated under stirring and under reflux for about 40 hours. After completion of the reaction, the reaction mixture was cooled to room temperature, and then filtered. A solid phase of the reaction mixture was discarded and the filtrate was concentrated under vacuum. MC (200 ml) and purified water (300 ml) are added to the concentrate and stirred for 30 min, and then an organic layer is separated. The organic layer was treated with $MgSO_4$, concentrated under vacuum, and then subjected to column purification with MC-methanol. 15.7 g of tetraethyl 2,2',2'',2'''-(1,4,7,10-tetraazacyclododecane-1,4,7,10-tetrayl)tetraacetate was obtained (Yield: 52.3%).

$^1$H NMR ($CDCl_3$): 4.19 (q, 8H), 3.19 (s, 8H), 2.48 (s, 16H), 1.27 (t, 12H).

Tetraethyl 2,2',2'',2'''-(1,4,7,10-tetraazacyclododecane-1,4,7,10-tetrayl)tetraacetate (15.7 g), NaOH (5.6 g), methanol (95 ml) and purified water (60 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (200 ml). The extracted organic layer was treated with $MgSO_4$. 9.9 g of the title compound was obtained (Yield: 80.5%).

$^1$H NMR (DMSO): 3.88 (s, 8H), 3.23 (s, 16H).

Embodiment 6

Preparation of 4,4',4'',4'''-(1,4,7,10-tetraazacyclododecane-1,4,7,10-tetrayl)tetrabenzoic Acid (Formula (2f))

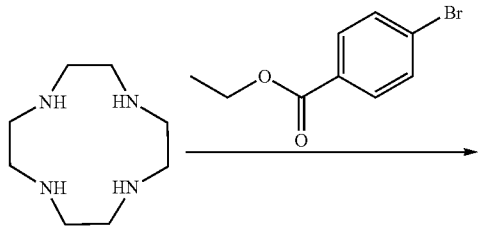

-continued

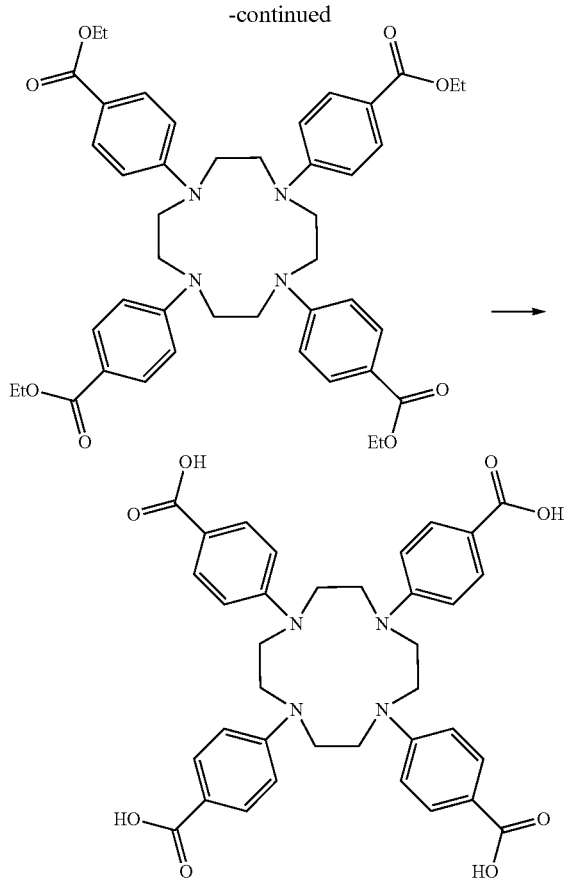

(2f)

Cyclen (10.0 g), ethyl 4-bromobenzoate (58.5 g), t-BuONa (27.9 g) and toluene (400 ml) were added, stirred, and then heated to 35° C. 50% $(t\text{-}Bu)_3P$ toluene solution (2.4 g) was added, stirred for about 30 min and then heated to 50° C. $Pd(dba)_2$ (1.7 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 15.8 g of tetraethyl 4,4',4",4'"-(1,4,7,10-tetraazacyclododecane-1,4,7,10-tetrayl)tetrabenzoate was obtained (Yield: 35.6%)

$^1$H NMR ($CDCl_3$): 7.81 (d, 8H), 6.98 (d, 8H), 4.15 (q, 8H), 3.48 (s, 16H), 1.25 (t, 12H).

Tetraethyl 4,4',4",4'"-(1,4,7,10-tetraazacyclododecane-1,4,7,10-tetrayl)tetrabenzoate (15.8 g), NaOH (3.8 g), methanol (130 ml) and purified water (100 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (130 ml). The extracted organic layer was treated with $MgSO_4$. 11.5 g of the title compound was obtained (Yield: 85.2%).

$^1$H NMR (DMSO): 7.82 (d, 8H), 6.97 (d, 8H), 3.45 (s, 16H).

Embodiment 7

Preparation of 5,5',5",5'"-(1,4,7,10-tetraazacyclododecane-1,4,7,10-tetrayl)tetranicotinic Acid (Formula (2g))

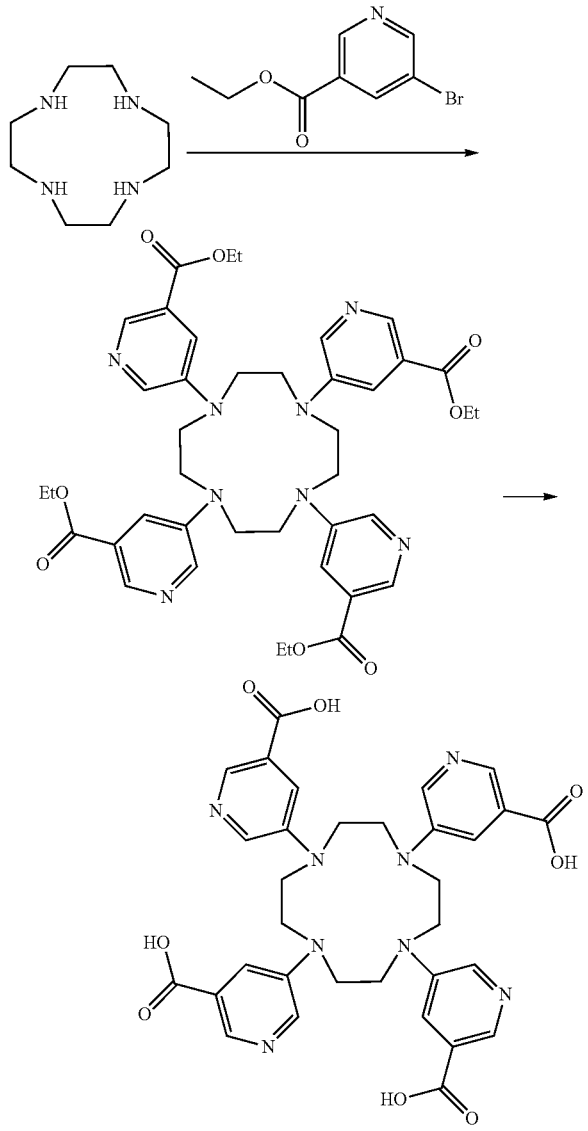

(2g)

Cyclen (10.0 g), 5-bromonicotinate (58.7 g), t-BuONa (27.9 g) and xylene (400 ml) were added, stirred, and then heated to 35° C. 50% $(t\text{-}Bu)_3P$ toluene solution (2.4 g) was added, stirred for about 30 min and then heated to 50° C. $Pd(dba)_2$ (1.7 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 17.9 g of tetraethyl 5,5',5",5'"-(1,4,7,10-tetraazacyclododecane-1,4,7,10-tetrayl)tetranicotinate was obtained (Yield: 40.1%)

$^1$H NMR ($CDCl_3$): 8.95 (d, 4H), 8.46 (d, 4H), 7.83 (d, 4H), 4.21 (q, 8H), 3.38 (s, 16H), 1.24 (t, 12H).

Tetraethyl 5,5',5",5'"-(1,4,7,10-tetraazacyclododecane-1,4,7,10-tetrayl)tetranicotinate (17.9 g), NaOH (4.3 g), methanol (150 ml) and purified water (110 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (160 ml). The extracted organic layer was treated with $MgSO_4$. 11.6 g of the title compound was obtained (Yield: 75.6%).

$^1$H NMR (DMSO): 8.96 (d, 4H), 8.44 (d, 4H), 7.84 (d, 4H), 3.36 (s, 16H).

Embodiment 8

Preparation of 5,5',5",5'"-(1,4,7,10-tetraazacyclododecane-1,4,7,10-tetrayl)tetrakis(furan-2-carboxylic Acid) (Formula (2h))

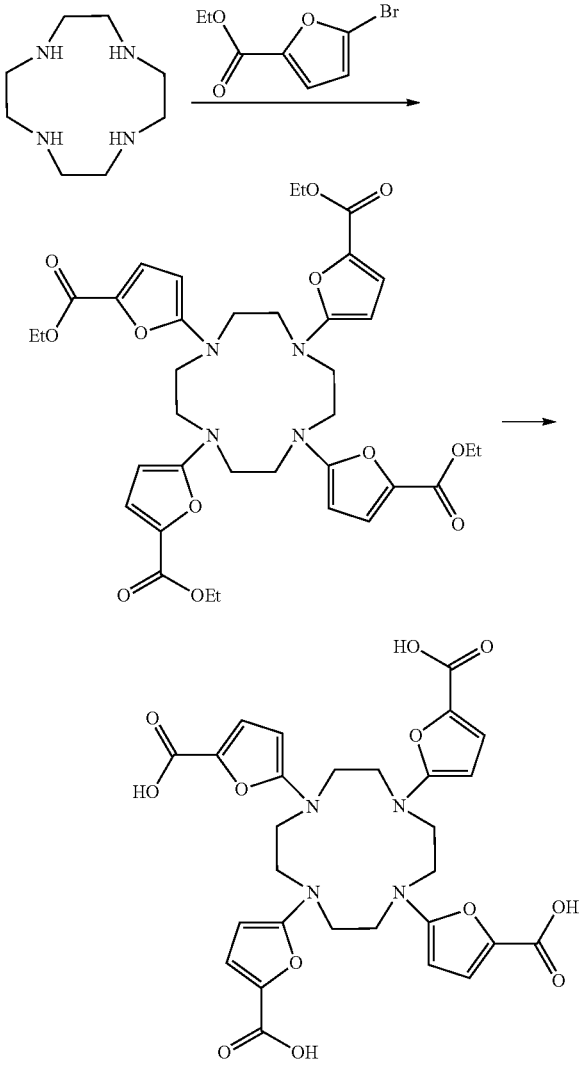

(2h)

Cyclen (10.0 g), ethyl 5-bromofuran-2-carboxylate (56.0 g), t-BuONa (27.9 g) and toluene (400 ml) were added, stirred, and then heated to 35° C. 50% $(t\text{-}Bu)_3P$ toluene solution (2.4 g) was added, stirred for about 30 min and then heated to 50° C. $Pd(dba)_2$ (1.7 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 12.6 g of tetraethyl 5,5',5",5'"-(1,4,7,10-tetraazacyclododecane-1,4,7,10-tetrayl)tetrakis(furan-2-carboxylat e) was obtained (Yield: 30.0%)

$^1$H NMR ($CDCl_3$): 7.39 (d, 8H), 4.35 (q, 8H), 3.28 (s, 16H), 1.35 (t, 12H).

Tetraethyl 5,5',5",5'"-(1,4,7,10-tetraazacyclododecane-1,4,7,10-tetrayl)tetrakis(furan-2-carboxylate) (12.6 g), NaOH (3.2 g), methanol (100 ml) and purified water (75 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (100 ml). The extracted organic layer was treated with $MgSO_4$. 7.9 g of the title compound was obtained (Yield: 73.9%).

$^1$H NMR (DMSO): 7.40 (d, 8H), 3.29 (s, 16H).

Synthesis of Cyclam Derivative

Embodiment 9

Preparation of 2,2',2",2'"-(1,4,8,11-tetraazacyclotetradecane-1,4,8,11-tetrayl)tetraacetic Acid (Formula (3e))

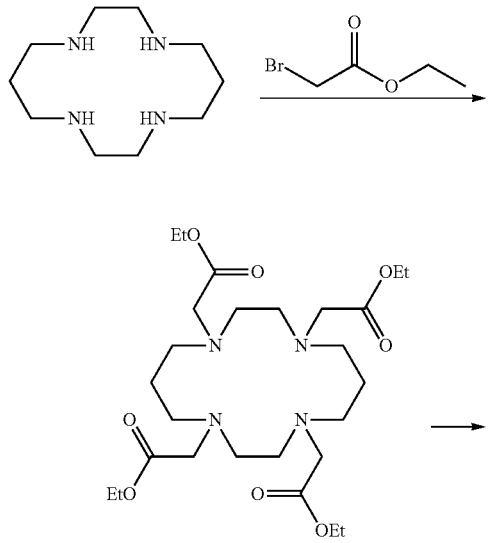

-continued

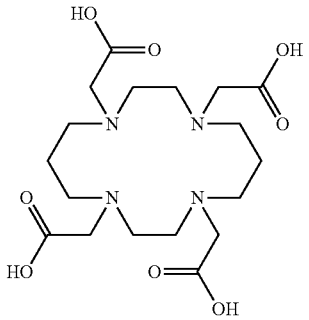

(3e)

Cyclam (10.0 g) was dissolved in acetonitrile (400 ml). $K_2CO_3$ (34.5 g) and ethyl bromoacetate (36.7 g) were added and reaction mixture was heated under stirring and under reflux for about 40 hours. After completion of the reaction, the reaction mixture was cooled to room temperature, and then filtered. A solid phase of the reaction mixture was discarded and the filtrate was concentrated under vacuum. MC (200 ml) and purified water (300 ml) are added to the concentrate and stirred for 30 min, and then an organic layer is separated. The organic layer was treated with $MgSO_4$, concentrated under vacuum, and then subjected to column purification with MC-methanol. 15.4 g of tetraethyl 2,2',2",2'"-(1,4,8,11-tetraazacyclotetradecane-1,4,8,11-tetrayl)tetraacetate was obtained (Yield: 56.8%).

$^1$H NMR ($CDCl_3$): 4.12 (q, 8H), 3.36 (s, 8H), 2.69~2.73 (m, 16H), 1.60 (m, 4H), 1.26 (t, 12H).

Tetraethyl 2,2',2",2'"-(1,4,8,11-tetraazacyclotetradecane-1,4,8,11-tetrayl)tetraacetate (15.4 g), NaOH (5.2 g), methanol (90 ml) and purified water (60 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (200 ml). The extracted organic layer was treated with $MgSO_4$. 9.3 g of the title compound was obtained (Yield: 75.9%).

$^1$H NMR ($D_2O$): 3.51 (s, 8H), 3.14 (s, 8H), 3.07 (t, 8H), 1.85 (q, 4H).

Embodiment 10

Preparation of 4,4',4",4'-(1,4,8,11-tetraazacyclotetradecane-1,4,8,11-tetrayl)tetrabenzoic Acid (Formula (3f))

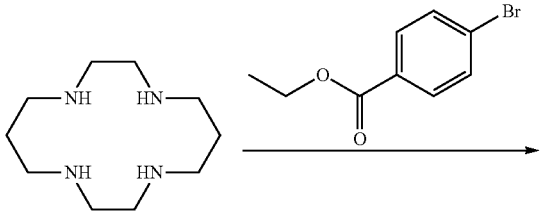

-continued

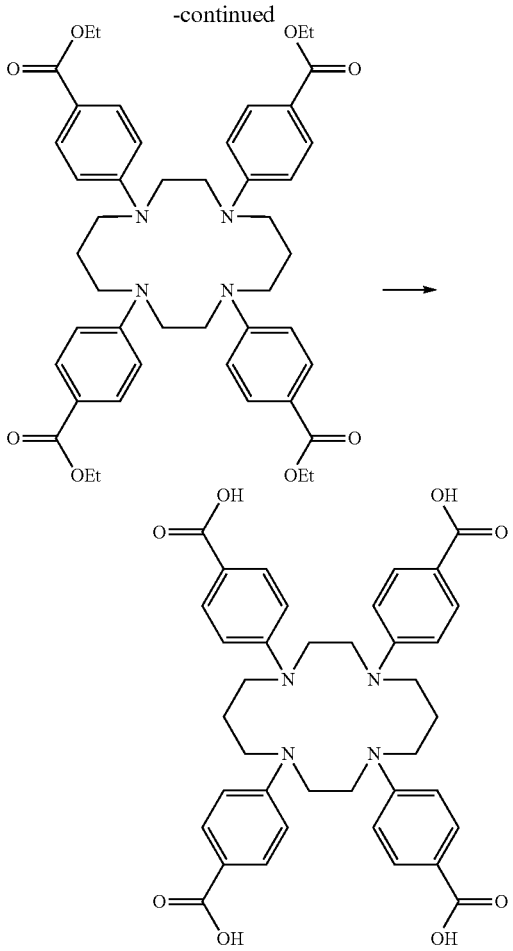

(3f)

Cyclam (10.0 g), ethyl 4-bromobenzoate (50.3 g), t-BuONa (24.0 g) and toluene (400 ml) were added, stirred, and then heated to 35° C. 50% $(t\text{-}Bu)_3P$ toluene solution (2.0 g) was added, stirred for about 30 min and then heated to 50° C. $Pd(dba)_2$ (1.5 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 12.3 g of tetraethyl 4,4',4",4'"-(1,4,8,11-tetraazacyclotetradecane-1,4,8,11-tetrayl)tetrabenzoate was obtained (Yield: 31.0%)

$^1$H NMR ($CDCl_3$): 7.80 (d, 8H), 6.94 (d, 8H), 4.13 (q, 8H), 2.65~2.71 (m, 16H), 1.65 (m, 4H), 1.26 (t, 12H).

Tetraethyl 4,4',4",4'"-(1,4,8,11-tetraazacyclotetradecane-1,4,8,11-tetrayl)tetrabenzoate (12.3 g), NaOH (2.6 g), methanol (70 ml) and purified water (100 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (100 ml). The extracted organic layer was treated with $MgSO_4$. 8.6 g of the title compound was obtained (Yield: 81.2%).

$^1$H NMR (DMSO): 7.83 (d, 8H), 6.95 (d, 8H), 2.63~2.73 (m, 16H), 1.62 (m, 4H).

Embodiment 11

Preparation of 5,5',5",5'"-(1,4,8,11-tetraazacyclotetradecane-1,4,8,11-tetrayl)tetranicotinic Acid (Formula (3g))

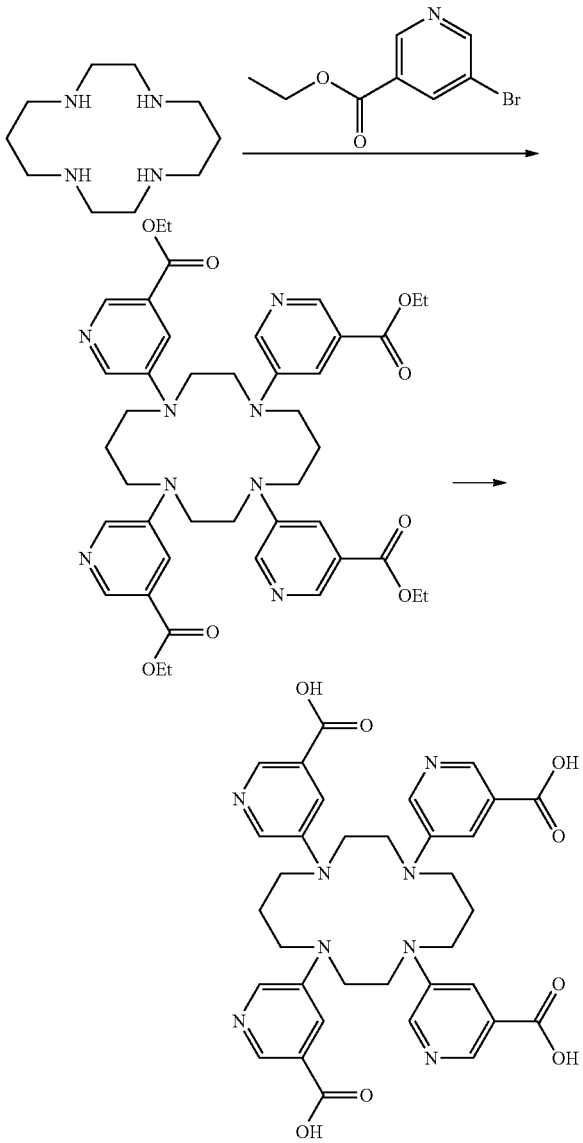

(3g)

Cyclam (10.0 g), ethyl 5-bromonicotinate (50.3 g), t-BuONa (24.0 g) and xylene (400 ml) were added, stirred, and then heated to 35° C. 50% $(t\text{-}Bu)_3P$ toluene solution (2.0 g) was added, stirred for about 30 min and then heated to 50° C. $Pd(dba)_2$ (1.5 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 11.1 g of tetraethyl 5,5',5",5'"-(1,4,8,11-tetraazacyclotetradecane-1,4,8,11-tetrayl)tetranicotinate was obtained (Yield: 27.8%)

$^1$H NMR ($CDCl_3$): 8.91 (d, 4H), 8.37 (d, 4H), 7.85 (d, 4H), 4.15 (q, 8H), 2.67~2.64 (m, 16H), 1.71 (m, 4H), 1.24 (t, 12H).

Tetraethyl 5,5',5",5'"-(1,4,8,11-tetraazacyclotetradecane-1,4,8,11-tetrayl)tetranicotinate (11.1 g), NaOH (2.6 g), methanol (90 ml) and purified water (70 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (120 ml). The extracted organic layer was treated with $MgSO_4$. 7.4 g of the title compound was obtained (Yield: 77.6%).

$^1$H NMR (DMSO): 8.93 (d, 4H), 8.38 (d, 4H), 7.85 (d, 4H), 2.67~2.66 (m, 16H), 1.72 (m, 4H).

Embodiment 12

Preparation of 5,5',5",5'"-(1,4,8,11-tetraazacyclotetradecane-1,4,8,1-tetrayl)tetrakis(furan-2-carboxylic Acid) (Formula (3h))

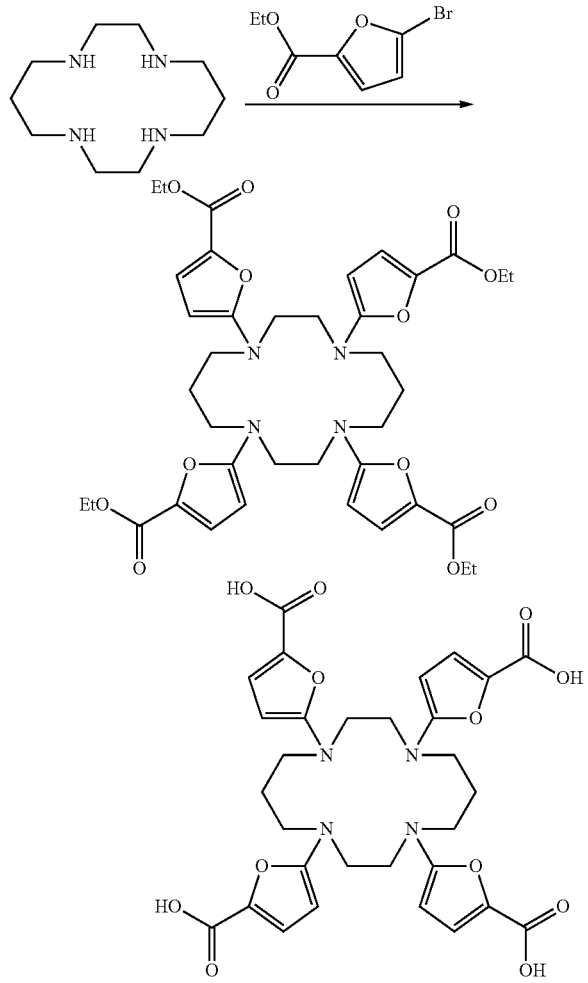

(3h)

Cyclam (10.0 g), ethyl 5-bromofuran-2-carboxylate (48.1 g), t-BuONa (24.0 g) and toluene (400 ml) were added, stirred, and then heated to 35° C. 50% $(t\text{-}Bu)_3P$ toluene solution (2.0 g) was added, stirred for about 30 min and then heated to 50° C. $Pd(dba)_2$ (1.5 g) was added, heated under reflux. After completion of the reaction, the reaction mixture was cooled to room temperature. a purified water (1000 ml) was added, stirred for 30 min, and then an organic layer is separated. An aqueous layer of the reaction mixture was discarded. The organic layer was treated with $MgSO_4$, concentrated under vacuum, and then subjected to column purification with MC-methanol. 14.1 g of tetraethyl 5,5',5'',5'''-(1,4,8,11-tetraazacyclotetradecane-1,4,8,11-tetrayl)tetrakis(furan-2-carboxylate) was obtained (Yield: 37.5%)

$^1$H NMR ($CDCl_3$): 7.40 (d, 8H), 4.23 (q, 8H), 2.65~2.71 (m, 16H), 1.66 (m, 4H), 1.29 (t, 12H).

Tetraethyl 5,5',5'',5'''-(1,4,8,11-tetraazacyclotetradecane-1,4,8,11-tetrayl)tetrakis(furan-2-carboxylate) (14.1 g), NaOH (3.5 g), methanol (110 ml) and purified water (85 ml) were added and the reaction mixture was heated to 55-60° C., stirred for 12 hours. After completion of the reaction, the reaction mixture was cooled to about 40° C. and concentrated under vacuum. The solvent was removed. The reaction mixture was adjusted to pH 5-6 with 10% aqueous HCl, stirred for 30 min, and extracted with MC (120 ml). The extracted organic layer was treated with $MgSO_4$. 9.4 g of the title compound was obtained (Yield: 78.1%).

$^1$H NMR (DMSO): 7.41 (d, 8H), 2.69~2.72 (m, 16H), 1.68 (m, 4H).

Embodiments 13 to 27: Preparation of Laundry Detergent Composition

Laundry detergent compositions were prepared, wherein detergents comprise 1 wt % trientine, cyclen, cyclam and the trientine derivatives, cyclen derivatives and cyclam derivatives prepared in the Embodiments 1 to 12.

The ingredients of the composition are shown in Table 1 below.

TABLE 1

| Laundry detergent composition | Active ingredient | Content of active ingredient (wt %) | Other ingredients (wt %) |
|---|---|---|---|
| Embodiment 13 | Trientine | 1 | Nonionic surfactant (14%) Anionic surfactant (7%) Sodium carbonate (20%) Sodium sulfate (23%) Sodium bicarbonate (15%) Zeolite (20%) |
| Embodiment 14 | Embodiment 1 | 1 | |
| Embodiment 15 | Embodiment 2 | 1 | |
| Embodiment 16 | Embodiment 3 | 1 | |
| Embodiment 17 | Embodiment 4 | 1 | |
| Embodiment 18 | Cyclen | 1 | |
| Embodiment 19 | Embodiment 5 | 1 | |
| Embodiment 20 | Embodiment 6 | 1 | |
| Embodiment 21 | Embodiment 7 | 1 | |
| Embodiment 22 | Embodiment 8 | 1 | |
| Embodiment 23 | Cyclam | 1 | |
| Embodiment 24 | Embodiment 9 | 1 | |
| Embodiment 25 | Embodiment 10 | 1 | |
| Embodiment 26 | Embodiment 11 | 1 | |
| Embodiment 27 | Embodiment 12 | 1 | |
| Comparative Example 1 | — | — | |

Experimental Example 1: Removal Test of Heavy Metals of Laundry Detergent

The clean towels were exposed to an external environment through which the wind was passed for a week to allow them to be contaminated with fine dust. The laundry was washed with the laundry detergent compositions prepared in Embodiments 13 to 27 and Comparative Example 1 in the washing machine, and then dried in drying machine. 1 g of the fine dust collected from the filter was mixed with distilled water (1 L) and the total amount of heavy metals (Cu, Zn, Mn, Ni, Cd) in the fine dust aqueous solution were measured with test kit (WAK-Me™, Kyoritsu Chemical-Check Lab).

The total amounts of heavy metals were measured by comparing the color of the aqueous solution with the standard color, and the results are shown in Table 2.

(Yellow) 0 ppm 0.2 ppm 0.5 ppm 1.0 ppm 2 ppm ≤5 ppm (red)

TABLE 2

| Laundry detergent composition | Active ingredient | Total amount (Cu, Zn, Mn, Ni, Cd) (ppm) |
|---|---|---|
| Embodiment 13 | Trientine | 1.0 |
| Embodiment 14 | Embodiment 1 | 1.0 |
| Embodiment 15 | Embodiment 2 | 1.0 |
| Embodiment 16 | Embodiment 3 | 1.0 |
| Embodiment 17 | Embodiment 4 | 1.0 |
| Embodiment 18 | Cyclen | 1.0 |
| Embodiment 19 | Embodiment 5 | 1.0 |
| Embodiment 20 | Embodiment 6 | 1.0 |
| Embodiment 21 | Embodiment 7 | 1.0 |
| Embodiment 22 | Embodiment 8 | 1.0 |
| Embodiment 23 | Cyclam | 1.0 |
| Embodiment 24 | Embodiment 9 | 1.0 |
| Embodiment 25 | Embodiment 10 | 1.0 |
| Embodiment 26 | Embodiment 11 | 1.0 |
| Embodiment 27 | Embodiment 12 | 1.0 |
| Comparative Example 1 | — | ≤5 (red) |

As shown in Table 2 above, The total heavy metal amount of the towel washed with the composition of Comparative Example 1 remains 5 ppm or more, while those of the towels washed with detergent composition of the present invention remain 1 ppm. It can be confirmed that the heavy metal amount is removed by about 80% in comparison with Comparative Example 1.

Experimental Example 2: Skin Irritation Test of Active Ingredient

A total of 20 people (10 men and 10 women in their 20s and 30s) were tested for skin irritation using the patch method according to the guidelines of CTFA (The Cosmetic, Toiletry & Fragrance Association, Inc. Washington, D.C.).

A filter paper disk was placed in an 8 mm diameter, 10 panels of pin chamber. Then, 20 μl each of the compositions according to Experimental Example 1 was dropped on a filter paper disk, naturally dried for 10 min, and then the pin chambers were attached to the subject's back region with a Scanpor tape.

After 24 hours, the pin chamber was removed, and skin conditions were visually observed. The degree and grade for skin irritation were calculated according to the following Equation 1, and the results are shown in Table 3 below.

$$\text{Degree of irritation} = \frac{[(\pm)\text{No.} \times 1 + (+)\text{No.} \times 2 + (++)\text{No.} \times 3]}{\text{Total number of subject}} \quad \text{Equation 1}$$

[Criteria for Skin Irritation]

(−): No erythema or particularly no symptoms; (±): slightly reddish than the periphery; (+): Apparent reddening than periphery; (++): More reddened and swollen than periphery.

[Grade for Skin Irritation]

Degree of irritation 0-0.1: Grade I (unstimulated);

Degree of irritation 0.11-0.3: Grade II (weakly stimulated);

Degree of irritation 0.31-0.5: Grade III (moderately stimulated);

Degree of irritation 0.51 or more: Grade IV (strongly stimulated)

TABLE 3

| Samples | | Test result | | | | | |
|---|---|---|---|---|---|---|---|
| | Content | (number of subject) | | | | Degree | |
| Active ingredient | (Wt %) | (−) | (± | (+) | (++) | of irritation | Grade |
| Trientine | 0.1% | 20 | 0 | 0 | 0 | 0 | I |
| | 0.5% | 19 | 1 | 0 | 0 | 0.05 | I |
| | 1.0% | 17 | 3 | 0 | 0 | 0.15 | II |
| Embodiment 1 | 0.1% | 20 | 0 | 0 | 0 | 0 | I |
| | 0.5% | 19 | 1 | 0 | 0 | 0.05 | I |
| | 1.0% | 16 | 4 | 0 | 0 | 0.20 | II |
| Embodiment 2 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Embodiment 3 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Embodiment 4 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Cyclen | 0.1% | 20 | 0 | 0 | 0 | 0 | I |
| | 0.5% | 20 | 0 | 0 | 0 | 0 | I |
| | 1.0% | 18 | 1 | 1 | 0 | 0.15 | II |
| Embodiment 5 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Embodiment 6 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Embodiment 7 | 0.1% | 20 | 0 | 0 | 0 | 0 | I |
| | 0.5% | 20 | 0 | 0 | 0 | 0 | I |
| | 1.0% | 20 | 0 | 0 | 0 | 0 | I |
| Embodiment 8 | 0.1% | 20 | 0 | 0 | 0 | 0 | I |
| | 0.5% | 20 | 0 | 0 | 0 | 0 | I |
| | 1.0% | 18 | 2 | 0 | 0 | 0.10 | I |
| Cyclam | 0.1% | 20 | 0 | 0 | 0 | 0 | I |
| | 0.5% | 19 | 1 | 0 | 0 | 0.05 | I |
| | 1.0% | 17 | 3 | 0 | 0 | 0.15 | II |
| Embodiment 9 | 0.1% | 20 | 0 | 0 | 0 | 0 | I |
| | 0.5% | 20 | 0 | 0 | 0 | 0 | I |
| | 1.0% | 18 | 2 | 0 | 0 | 0.10 | I |
| Embodiment 10 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Embodiment 11 | 0.1% | 20 | 0 | 0 | 0 | 0 | I |
| | 0.5% | 20 | 0 | 0 | 0 | 0 | I |
| | 1.0% | 18 | 2 | 0 | 0 | 0.10 | I |
| Embodiment 12 | 0.1% | 20 | 0 | 0 | 0 | 0 | I |
| | 0.5% | 20 | 0 | 0 | 0 | 0 | I |
| | 1.0% | 19 | 1 | 0 | 0 | 0.05 | I |
| Comparative | 0.1% | 20 | 2 | 0 | 0 | 0.10 | I |
| Example 1 | 0.5% | 17 | 2 | 1 | 0 | 0.20 | II |
| (EDTA) | 1.0% | 15 | 3 | 2 | 0 | 0.35 | III |

As shown in Table 3, all of the compounds according to the present invention have grade I, which is a non-stimulating range, within the concentration range of 0.5 wt % in the human skin irritation test. In the concentration range of 1.0 wt %, trientine, cyclen and cyclam have grade II (light stimulus range), whereas all of these aromatic and heterocyclic derivatives have grade I, indicating that skin irritation reduction is improved. On the other hand, The EDTA of Comparative Example 1 was evaluated to be grade III (moderate irritation range) at a concentration of 1.0 wt %, indicating that the skin irritation is higher than those of the compounds of the present invention.

Embodiments 28 to 42: Preparation of Plastics Detergent Composition

Detergent compositions for plastics (feeding bottle) were prepared, wherein detergents comprise 1 wt % trientine, cyclen, cyclam and the trientine derivatives, cyclen derivatives and cyclam derivatives prepared in the Embodiments 1 to 12.

The ingredients of the composition are shown in Table 4 below

TABLE 4

| Laundry detergent composition | Active ingredient | Content of active ingredient (wt %) | Other ingredients (wt %) |
|---|---|---|---|
| Embodiment 28 | Trientine | 1 | High-grade |
| Embodiment 29 | Embodiment 1 | 1 | amine-based |
| Embodiment 30 | Embodiment 2 | 1 | nonionic surfactant |
| Embodiment 31 | Embodiment 3 | 1 | (9%) High-grade |
| Embodiment 32 | Embodiment 4 | 1 | alcohol-based |
| Embodiment 33 | Cyclen | 1 | anionic surfactant |
| Embodiment 34 | Embodiment 5 | 1 | (4%) Olefin-based |
| Embodiment 35 | Embodiment 6 | 1 | anionic surfactant |
| Embodiment 36 | Embodiment 7 | 1 | (4%) Purified water |
| Embodiment 37 | Embodiment 8 | 1 | |
| Embodiment 38 | Cyclam | 1 | |
| Embodiment 39 | Embodiment 9 | 1 | |
| Embodiment 40 | Embodiment 10 | 1 | |
| Embodiment 41 | Embodiment 11 | 1 | |
| Embodiment 42 | Embodiment 12 | 1 | |
| Comparative Example 2 | — | — | |

Experimental Example 3: Removal Test of Heavy Metals of Plastics Detergent 1000 ppm of cadmium chloride aqueous solution was poured into a feeding bottle and allowed to stand for 1 day and then washed using the plastics detergent compositions prepared in Embodiments 13 to 27 and Comparative Example 2. The distilled water was added to the washed bottle and mixed for 10 minutes. The total amount of heavy metals (Cu, Zn, Mn, Ni, Cd) in aqueous solution were measured with test kit (WAK-Me™, Kyoritsu Chemical-Check Lab).

The total amounts of heavy metals were measured by comparing the color of the aqueous solution with the standard color, and the results are shown in Table 5.

(Yellow) 0 ppm 0.2 ppm 0.5 ppm 1.0 ppm 2 ppm ≤5 ppm (red)

TABLE 5

| Plastics detergent composition | Active ingredient | Total amount(Cu, Zn, Mn, Ni, Cd) (ppm) |
|---|---|---|
| Embodiment 13 | Trientine | 0.5 |
| Embodiment 14 | Embodiment 1 | 0.5 |
| Embodiment 15 | Embodiment 2 | 0.5 |
| Embodiment 16 | Embodiment 3 | 0.5 |
| Embodiment 17 | Embodiment 4 | 0.5 |
| Embodiment 18 | Cyclen | 0.5 |
| Embodiment 19 | Embodiment 5 | 0.5 |
| Embodiment 20 | Embodiment 6 | 0.5 |
| Embodiment 21 | Embodiment 7 | 0.5 |
| Embodiment 22 | Embodiment 8 | 0.5 |
| Embodiment 23 | Cyclam | 0.5 |
| Embodiment 24 | Embodiment 9 | 0.5 |
| Embodiment 25 | Embodiment 10 | 0.5 |
| Embodiment 26 | Embodiment 11 | 0.5 |
| Embodiment 27 | Embodiment 12 | 0.5 |
| Comparative Example 2 | — | 2.0 |

As shown in Table 5 above, The total heavy metal amount of the towel washed with the composition of Comparative Example 2 remains 2 ppm, while those of the towels washed with detergent composition of the present invention remain 0.5 ppm. It can be confirmed that the heavy metal amount is removed by about 75% in comparison with Comparative Example 2.

Experimental Example 4: Formaldehyde Removing Ability Test

Purified water was added to 35.0% formaldehyde solution to prepare a 2.0% diluted solution of formaldehyde. 3 molar equivalents of Trientine, cyclen, cyclam, and derivative compounds of the present invention were added to the diluted solution, and the change of amount of formaldehyde was analyzed by gas chromatography (GC) while stirring at room temperature.

The content of formaldehyde was measured under the following analysis conditions in the initial state, after 30 min and 180 min, the result was shown in Table 6.

<GC Analysis Conditions>

Detector: Flame ionization detector

Column: ZB-1 (0.32 mm×30 m, 3.00 m) or a similar column.

Headspace conditions: equilibrium temperature 60° C., equilibration time 10 min, transfer line temperature 65° C.

Column temperature: Keep at 50° C. for the first 5 min, then increase the temperature to 200° C. by 30° C. per minute and maintain at 200° C. for 10 min.

Sample inlet temperature: constant temperature around 140° C.

Detector temperature: constant temperature around 250° C.

Carrier gas: nitrogen

Split ratio: about 1:20

Flow rate: 2.5 mL/min

Injection amount: 5 μL of the sample solution is injected into the vial with microsyringe. 1 mL of the vapor phase is injected into the column according to the head space conditions.

Analysis time: 20 min

TABLE 6

| Active ingredient | Area (mAU * min) Initial | 30 min | 180 min |
|---|---|---|---|
| Trientine | 0.305 | 0.168 | 0 |
| Embodiment 1 | 0.305 | 0.170 | 0 |
| Embodiment 2 | 0.305 | 0.168 | 0 |
| Embodiment 3 | 0.305 | 0.171 | 0 |
| Embodiment 4 | 0.305 | 0.173 | 0 |
| Cyclen | 0.305 | 0.181 | 0 |
| Embodiment 5 | 0.305 | 0.179 | 0 |
| Embodiment 6 | 0.305 | 0.183 | 0 |
| Embodiment 7 | 0.305 | 0.181 | 0 |
| Embodiment 8 | 0.305 | 0.168 | 0 |
| Cyclam | 0.305 | 0.172 | 0 |
| Embodiment 9 | 0.305 | 0.182 | 0 |
| Embodiment 10 | 0.305 | 0.171 | 0 |
| Embodiment 11 | 0.305 | 0.174 | 0 |
| Embodiment 12 | 0.305 | 0.170 | 0 |

As shown in Table 6, GC analysis shows that the formaldehyde was remarkably reduced by about 40% to 45% in 30 min after the addition of the compounds of the present invention and completely undetected after 180 min. This means that the compounds of the present invention effectively remove formaldehyde.

This means that the active ingredient of the present invention adsorbs effectively with formaldehyde, and that the detergent composition of the present invention can be effectively used for removing formaldehyde, which is a causative substance of sick house syndrome.

INDUSTRIAL APPLICABILITY

The present invention relates to detergent compositions which can be used as a laundry detergents, dishwashing detergent, and cleanser for various household appliances such as plastics, toys, bottles, furniture etc. In particular, the present invention relates to a detergent composition for effectively removing heavy metals and formaldehyde which are harmful substances present in these materials.

The invention claimed is:

1. A method of using detergent composition, comprising trientine of Formula (1a) as a detergent for removing heavy metals and formaldehyde

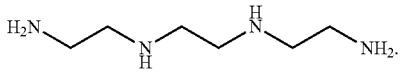

(1a)

2. The method of claim 1, wherein trientine or trientine derivative is comprised in the range of 0.01 to 5.0 wt %, based a total weight of the detergent composition.

3. The method of claim 1, wherein the said detergent composition is used as laundry detergent.

4. The method of claim 1, wherein the said detergent composition is used as household detergent, dishwashing detergent, feeding bottle detergent or detergent for washing agricultural products.

* * * * *